United States Patent [19]

Aton

[11] 4,439,817

[45] Mar. 27, 1984

[54] STICK-ON FOG LIGHT LENS FOR HEADLIGHT

[76] Inventor: Ronald L. Aton, 202 Spencer Rd., New Lenox, Ill. 60451

[21] Appl. No.: 284,167

[22] Filed: Jul. 17, 1981

[51] Int. Cl.[3] ..... F21M 3/14

[52] U.S. Cl. ..... 362/255; 362/80; 362/83; 362/268; 362/278; 362/293; 362/307; 362/310; 362/311; 362/320; 362/317; 362/318; 362/331; 362/355; 362/359; 362/375

[58] Field of Search ..... 362/268, 455, 331, 82, 362/320, 278, 293, 355, 317, 307, 311, 96, 306, 80, 318, 83, 310, 318, 359, 375; 156/306.3

[56] References Cited

U.S. PATENT DOCUMENTS

| | | | |
|---|---|---|---|
| 720,491 | 2/1903 | Schroeder et al. | 362/278 |
| 2,499,555 | 3/1950 | Wronkowski | 362/293 |
| 2,544,378 | 3/1951 | Cyr | 362/317 |
| 2,734,129 | 2/1956 | Kahla | 362/320 X |
| 2,791,680 | 5/1957 | Bailey | 362/331 |
| 2,807,711 | 9/1957 | McDonald | 362/455 X |
| 2,903,570 | 9/1959 | Worden | 362/268 |
| 2,904,672 | 9/1959 | Fischer | 362/318 |
| 3,334,220 | 8/1967 | Komiske | 362/355 |
| 3,511,365 | 5/1970 | Pow | 206/390 |
| 3,609,345 | 9/1971 | Perkiss | 362/317 X |
| 3,696,238 | 10/1972 | Szymanski | 362/61 X |
| 3,868,293 | 2/1975 | Selph | 428/14 X |
| 3,934,301 | 1/1976 | DiSalvo et al. | 362/253 X |
| 4,152,753 | 5/1979 | Amann | 362/311 X |
| 4,225,904 | 9/1980 | Linder | 362/61 |

FOREIGN PATENT DOCUMENTS

| | | | |
|---|---|---|---|
| 2016854 | 10/1971 | Fed. Rep. of Germany | 362/96 |

*Primary Examiner*—Donald G. Kelly
*Assistant Examiner*—John S. Maples
*Attorney, Agent, or Firm*—Ernest Kettelson

[57] ABSTRACT

A stick-on fog light lens, comprising a flexible sheet of amber colored transparent vinyl having a peripheral configuration cut to match that of the headlight of an automobile on which it is to be used, and a method of affixing to the headlight by moistening one side of the flexible vinyl sheet with water, placing the moistened side against the glass lens of the headlight, and pressing out excess moisture and air thereby leaving the flexible sheet fog light lens operably affixed to the headlight.

5 Claims, 4 Drawing Figures

STICK-ON FOG LIGHT LENS FOR HEADLIGHT

BACKGROUND OF THE INVENTION

This invention relates to the field of special lens affixed to existing lamps, such as the headlights of automobiles, to provide a light better able to penetrate and illuminate during conditions of fog.

Prior art lens of this kind have required the use of special fastening materials, adhesives, clips and other fastening devices to fasten the lens to the headlight or other lamps. Examples of patents which disclose prior art lens and fastening devices of that kind include the following U.S. Pat. Nos. 4,225,904; 3,868,293; 3,696,238; 3,511,365; 2,734,129; and 720,491.

The present invention dispenses with such fastening devices, and uses amber color soft flexible vinyl which will adhere to the surface of a headlight lens by moistening with water. No other fastening device, or apparatus, or adhesive, or other prior art fastening means is needed. The flexible vinyl fog lens in accordance with this invention when affixed to the lens of a headlight in this manner will stay in place indefinitely while travelling great distances. The invention also facilitates removal, since the soft flexible vinyl lens peel off from the headlight without difficulty. Since they have no adhesive backing, special care is not required for storage nor do the surfaces from which they are removed need to be wiped free of any sticky adhesive substance. Nor are there any screws, bolts, magnets, rims, springs or other fastening devices to keep track of and store for future use. The soft flexible vinyl fog lens in accordance with this invention may simply be folded flat, placed in a convenient storage folder and stored out of the way in the glove compartment of the car.

SUMMARY OF THE INVENTION

It is an object of the invention to provide a fog lens for use over the existing headlights of vehicles which does not require any special fastening devices or materials.

It is an object of the invention to provide a soft flexible sheet of transparent amber colored vinyl for placement over the existing lens of a lamp for use as a fog light and to hold it in place by moistening the side of the vinyl sheet adjacent the lens with water.

DESCRIPTION OF PREFERRED EMBODIMENT

Figure 1:
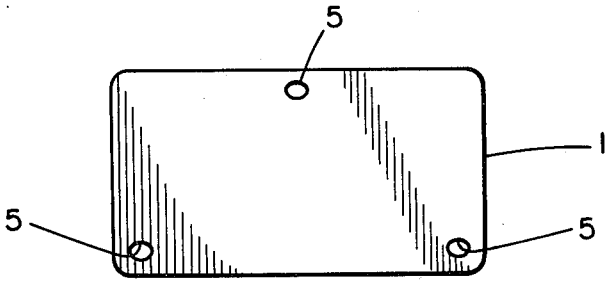
FIG. 1 is a plan view of a soft flexible sheet of amber colored transparent vinyl comprising a fog lens in accordance with this invention having a peripheral configuration matching that of a rectangular headlight lens of an automobile.

A fog lens in accordance with this invention comprises a soft, flexible sheet of amber colored vinyl 1, available commerically as matt vinyl and having a thickness of about six mils, which is cut into the peripheral outline shape of an automobile headlight 2 or other lamp on which it is going to be used.

In the drawings, the type of headlight shown is a rectangular sealed beam headlight in which the glass lens 3 has three projections 4. To fit this headlight 2 and enable the facing surface of the soft flexible sheet 1 to come into close contact with the glass surface of the glass lens 3 throughout the entire mutually facing area, the soft vinyl sheet 1 has three corresponding apertures 5 located for registration with the 3 projections 4 of the glass lens 3 where the soft vinyl sheet 1 comprising the fog lens is put in place over the glass lens.

Figure 2:
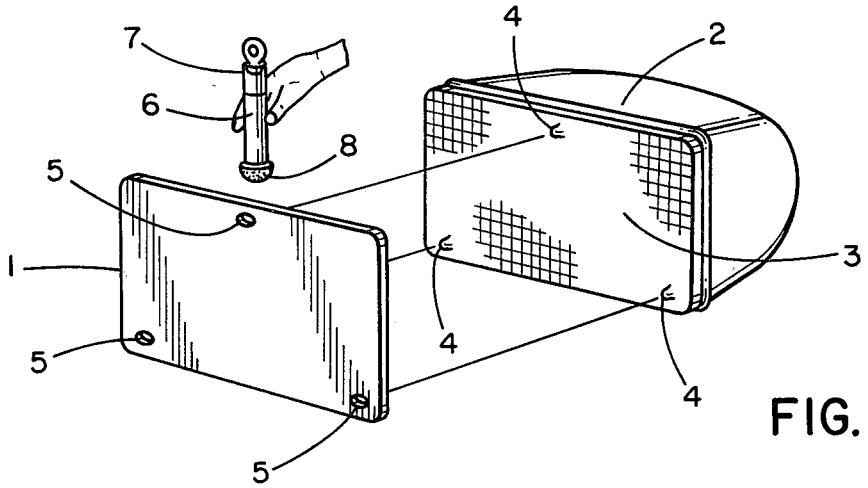
FIG. 2 is a perspective view of an automobile headlight with the soft, flexible fog lens of FIG. 1 shown in position for affixing to the headlight.
Figure 3:
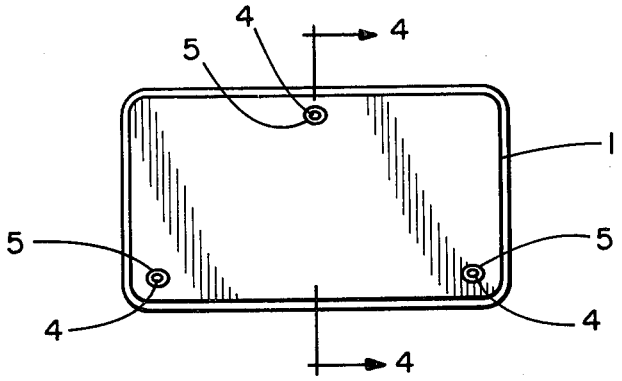
FIG. 3 is a front elevation view of an automobile headlight having a soft, flexible fog lens in accordance with this invention affixed thereto.
Figure 4:
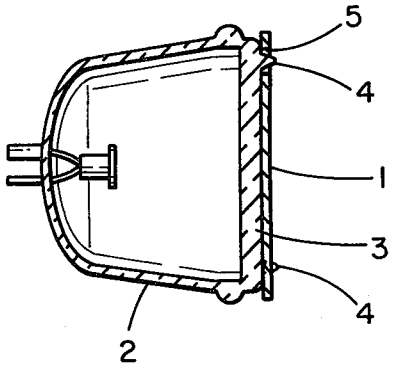
FIG. 4 is a section view taken on line 4—4 of FIG. 3.

Before placing the fog lens comprising soft vinyl sheet 1 on the glass lens 3 of headlight 2, the surface of vinyl sheet 1 which is to contact the surface of glass lens 3 is moistened with ordinary water 6, as by means of the applicator 7 having a sponge 8 as shown in FIG. 2. The contact surface of vinyl sheet 1 should be completely moistened throughout its entire area and then placed over the surface of glass lens 3, the projections 4 of glass lens 3 being received through the apertures 5 of the fog lens soft vinyl sheet 1 to enable a close surface to surface contact between the vinyl sheet 1 and the glass lens 3 throughout their entire mutually facing area. The soft vinyl sheet 1 is pressed firmly against the glass lens 3 to squeeze out any excess water and to remove any air pockets.

The fog lens soft vinyl sheet 1 will stay securely affixed to the glass lens 3 of the headlight 2 when put in place as described above, and will remain affixed while driving great distances and for substantial periods of time.

The fog lens soft vinyl sheet 1 is removed from the glass lens 3 by simply grasping an edge of the vinyl sheet 1 and peeling it off. The remaining moisture is then wiped from the vinyl sheet 1 as well as from the glass lens of the headlight, and the vinyl sheet 1 may then be stored for future use.

I claim:

1. A combination fog lens and headlight, wherein said headlight includes a glass lens, said fog lens comprises a thin sheet of soft flexible transparent plastic material having a peripheral configuration corresponding to that of said glass lens of said headlight, said thin sheet of plastic material having a contact surface for adhering to said glass lens of said headlight throughout their mutually facing area, said contact surface being moistened throughout with water to bond said thin sheet of plastic material to said glass lens of said headlight, said glass lens including at least one projection extending outwardly therefrom, said fog lens including a corresponding aperture to receive said projection therethrough when said plastic sheet is placed on said glass lens.

2. A combination fog lens and headlight as set forth in claim 1, wherein said plastic material is vinyl.

3. A combination fog lens and headlight as set forth in claim 2, wherein said thin sheet of soft flexible transparent vinyl is amber colored.

4. A combination fog lens and headlight as set forth in claim 1, wherein said thin sheet of plastic material is approximately 6 mils thick.

5. A combination fog lens and headlight, wherein said headlight includes a glass lens, a plurality of projections formed in said glass lens in spaced apart relationship and extending outwardly therefrom, said fog lens comprises a thin sheet of transparent matt vinyl having a peripheral outline configuration corresponding to that of said glass lens of said headlight, a plurality of apertures through said fog lens spaced apart and located for registration with said plurality of projections of said glass lens of said headlight when said fog lens is placed on said glass lens whereby said projections of said glass lens then project through said apertures of said fog lens, said fog lens having a contact surface facing said glass lens when placed thereon, said contact surface of said fog lens being covered throughout its surface area with water prior to placing on said glass lens of said headlight, said water in contact with said fog lens causing it to adhere throughout its surface area to said glass lens when placed thereon.

* * * * *